United States Patent [19]

Murata

[11] Patent Number: 5,072,643

[45] Date of Patent: Dec. 17, 1991

[54] STRINGED MUSICAL INSTRUMENT AND MANUFACTURING METHOD OF SAME

[75] Inventor: Yoshiyuki Murata, Tachikawa, Japan

[73] Assignee: Casio Computer Co., Ltd., Tokyo, Japan

[21] Appl. No.: 680,041

[22] Filed: Mar. 29, 1991

Related U.S. Application Data

[63] Continuation of Ser. No. 403,176, Sep. 1, 1989, abandoned.

[30] Foreign Application Priority Data

Sep. 9, 1988 [JP] Japan ..... 63-224785

[51] Int. Cl.[5] ..... G10D 3/00

[52] U.S. Cl. ..... 84/293

[58] Field of Search ..... 84/267, 290, 291, 293, 84/314 R

[56] References Cited

U.S. PATENT DOCUMENTS

| | | | |
|---|---|---|---|
| 3,712,952 | 1/1973 | Terlinde . | |
| 3,791,252 | 2/1974 | Sibert et al. | 84/293 |
| 3,880,040 | 4/1975 | Kaman | 84/291 |
| 3,911,778 | 10/1975 | Martin | 84/267 |
| 3,943,816 | 3/1976 | Goursau | 84/293 |
| 4,145,948 | 3/1979 | Turner | 84/293 |
| 4,188,850 | 2/1980 | Kaman, II | 84/291 |
| 4,192,213 | 3/1989 | Steinberger | 84/293 |
| 4,221,151 | 9/1980 | Barth | 84/293 X |
| 4,313,362 | 2/1982 | Lieber | 84/293 X |
| 4,633,754 | 1/1987 | Chapman | 84/314 R |
| 4,658,690 | 4/1987 | Aitken | 84/267 |
| 4,723,469 | 2/1988 | Vogt | 84/314 R |
| 4,748,887 | 6/1988 | Marshall | 84/646 |
| 4,777,858 | 10/1988 | Petschulat | 84/314 R |

FOREIGN PATENT DOCUMENTS

| | | |
|---|---|---|
| 3028624A1 | 2/1982 | Fed. Rep. of Germany . |
| 53-114229 | 9/1978 | Japan . |
| 58-195291 | 12/1983 | Japan . |
| 60-21094 | 2/1985 | Japan . |
| 61-259293 | 11/1986 | Japan . |
| WO87/00330 | 1/1987 | PCT Int'l Appl. . |

*Primary Examiner*—Brian W. Brown

*Attorney, Agent, or Firm*—Frishauf, Holtz, Goodman & Woodward

[57] ABSTRACT

This invention relates to a stringed musical instrument such as an electronic guitar, a guitar synthesizer, an electronic violin and an acoustic guitar. A fret structure member is formed by integrally forming a plurality of frets. The fret structure member is molding in a neck portion or fingerboard so as to project a head portion of each of said frets from a fingerboard surface of said neck portion or said fingerboard molded by a synthetic resin. Each base end portion of said plurality of frets is integrally molding in said neck portion or said fingerboard molded by said synthetic resin.

8 Claims, 20 Drawing Sheets

STRINGED MUSICAL INSTRUMENT AND MANUFACTURING METHOD OF SAME

This application is a continuation, of application Ser. No. 07/403,176, filed Sept. 1, 1989, now abandoned.

BACKGROUND OF THE INVENTION

1. Field of the Invention

This invention relates to a stringed musical instrument, such as an electronic guitar, a guitar synthesizer and an electronic violin, and a manufacturing method of the same.

2. Description of the Related Art

Recently, there have been known such stringed musical instruments, for example, electronic guitars and electric guitars, that the whole thereof (that is, the body portion and the neck portion) or a portion thereof (for example, the body portion or the neck portion) is made of synthetic resin such as carbon-fiber reinforced resin (see, for example, U.S. Pat. Nos. 3,880,040, 3,943,816, 4,145,948 and No. 4,192,213, and published and unexamined Japanese Patent Disclosures (KOKAI) No. 60-21094 and No. 61-259293). The reasons why stringed musical instruments are made of synthetic resin are as follows:

First, wood material such as maple, beech and mahogany of which stringed musical instruments have been made is expensive and good quality materials are is not easily purchased.

Secondly, such wood material varies in quality and requires a long seasoning time, so that it is not suited for mass production of stringed musical instruments.

A plurality of frets are arranged on the fingerboard of the neck portion of the stringed musical instrument. In the conventional stringed musical instrument in which the neck portion is made of molded resin material, the frets are fixed onto the neck portion just like the conventional musical instrument in which the neck portion is made of wood. That is to say, each fret made as a single member is struck into corresponding one of fret grooves which are previously formed in the predetermined portions on the fingerboard and each of which has a rectangular cross section.

The fret fixing method in which a plurality of single frets are fixed to the fingerboard one by one requires much fixing time and is not suited for mass production. Moreover, it is difficult to arrange the frets such that the head portions of the frets are disposed at the same level. When the head portions of the frets are not at the same level, the strings stretched on the fingerboard are not evenly pressed against the fingerboard. Therefore, the required musical intervals cannot be accurately obtained.

Each fret is fixed to the fingerboard only by surface contact of the base end portion of each fret to the corresponding fret groove. Therefor, the frets are likely to be removed from the fingerboard when a large force is exerted on the frets.

Since the frets ar forcedly fitted in the fret grooves in order to increase the degree of fixing force of the frets to the fingerboard, the base end portions of the frets act to broaden the fret grooves. As a result, the overall fingerboard or the overall neck is likely to be curved. This curving must be compensated by compensating means such as an adjusting rod.

Recently, improved stringed musical instruments in which the frets are integrally formed each other have been developed in order to solve the above described problem. For example, published and unexamined Patent Application of Federal Republic of Germany No. 3028624 Al (published and unexamined Japanese Patent Disclosure (KOKAI) No. 56-122093 corresponds thereto discloses a stringed musical instrument in which a belt-like fret member consisted of frets integrally formed each other is integrally mounted on a neck member by means of an adhesive.

With this stringed musical instrument, the arrangement and the height adjustment of the frets can be made at a high accuracy, irrespective of the skill of factory workers of the instrument. However, these adhering works for fixing the fret members to the neck member by means of the adhesive is cumbersome and the adhered portion lowers the mechanical strength of the stringed musical instrument.

SUMMARY OF THE INVENTION

This invention was made to overcome the problems occurring in the conventional stringed musical instruments.

An object of this invention is to provide a stringed musical instrument in which the frets are accurately arranged at the same level on the neck member without using an adhesive and to provide a manufacturing method of such a stringed musical instrument.

Another object of this invention is to provide a rigid stringed musical instrument in which the neck member is not curved or bent even when a plurality of strings are stretched under a high tension.

A further object of this invention is to provide a rigid stringed musical instrument in which the neck portion itself or the connecting portion between the neck portion and the body portion is not curved or bent even when a plurality of strings are stretched over the neck portion and the body portion under a high tension.

A still further object of this invention is to provide a stringed musical instrument in which the connecting strength between the neck portion and the body portion is increased, and to provide a manufacturing method of such a stringed musical instrument.

A further object of this invention is to provide a stringed musical instrument which is light but has a high stiffness.

A still further object of this invention is to provide a stringed musical instrument having a neck portion not to be curved and to provide a manufacturing method of the instrument.

A further object of this invention is to provide a manufacturing method which can quickly and easily manufacture a stringed musical instrument having a plurality of frets.

According to one aspect of this invention, there is provided a stringed musical instrument comprising a neck member, and a fret structure member constructed by one-piece molding of a plurality of frets, these frets being to be arranged at predetermined intervals on a fingerboard surface formed on the neck member. The fret structure member is integrally molded in the interior of the neck portion, so that the head portion of each of the frets projects out from the fingerboard surface. At least one of the fret structure member and the neck portion is made of synthetic resin material. Preferably, the synthetic resin material is fiber-reinforced resin material in order to increase the mechanical strength of the fret structure member and the neck portion. It is also preferable that the fret structure member is provided with engaging portions, such as engaging holes or engaging projections, in order to increase the connecting force of the fret structure member.

According to another aspect of this invention, the above described stringed musical instrument, having the neck portion and the fret structure member, further comprises a head member integrally formed on one end of the neck portion, and a head support member integrally formed with the fret structure member and integrally molded in the interior of the head member so as to support the head member. It is preferable that a string support portion for supporting one end of each string is integrally formed with the head support member.

According to still another aspect of this invention, the above described stringed musical instrument, having the neck portion, the fret structure member, the head member, and the head support member, further comprises a body member integrally formed on the other end of the neck member, and a body support member integrally formed with the fret structure member and integrally molded in the interior of the body member so as to support the body member. Preferably, a string support member for supporting the other end of each string is integrally formed with the body support member.

According to a further aspect of this invention, there is provided a stringed musical instrument in which each of the base end portions of a plurality of frets, these frets being to be arranged parallel to each other at predetermined intervals, are integrally molded on a fingerboard made of synthetic resin.

According to a still further aspect of this invention, there is provided a method for manufacturing a stringed musical instrument comprising a step for disposing a fret structure member, which is constructed by a plurality of frets integrally formed each other, within a cavity, which is defined in a metallic mold and has a mold shape corresponding to an outer shape of a neck, and a step for pressure injecting a synthetic resin material in the cavity to mold the neck portion in the cavity and to integrally mold the fret structure member in the neck portion so as to project the frets from a fingerboard surface formed on the neck portion.

According to a still further aspect of this invention, there is provided a stringed musical instrument comprising an upper half body covering the upper portion of an electronic part provided therein, a lower half body covering the lower portion of the electronic part, and an elastic packing member interposed between the upper and lower half bodies.

BRIEF DESCRIPTION OF THE DRAWINGS

The invention can be fully understood from the following detailed description with reference to the accompanying drawings in which.

DETAILED DESCRIPTION OF THE PREFERRED EMBODIMENTS

First Embodiment

Figure 1:
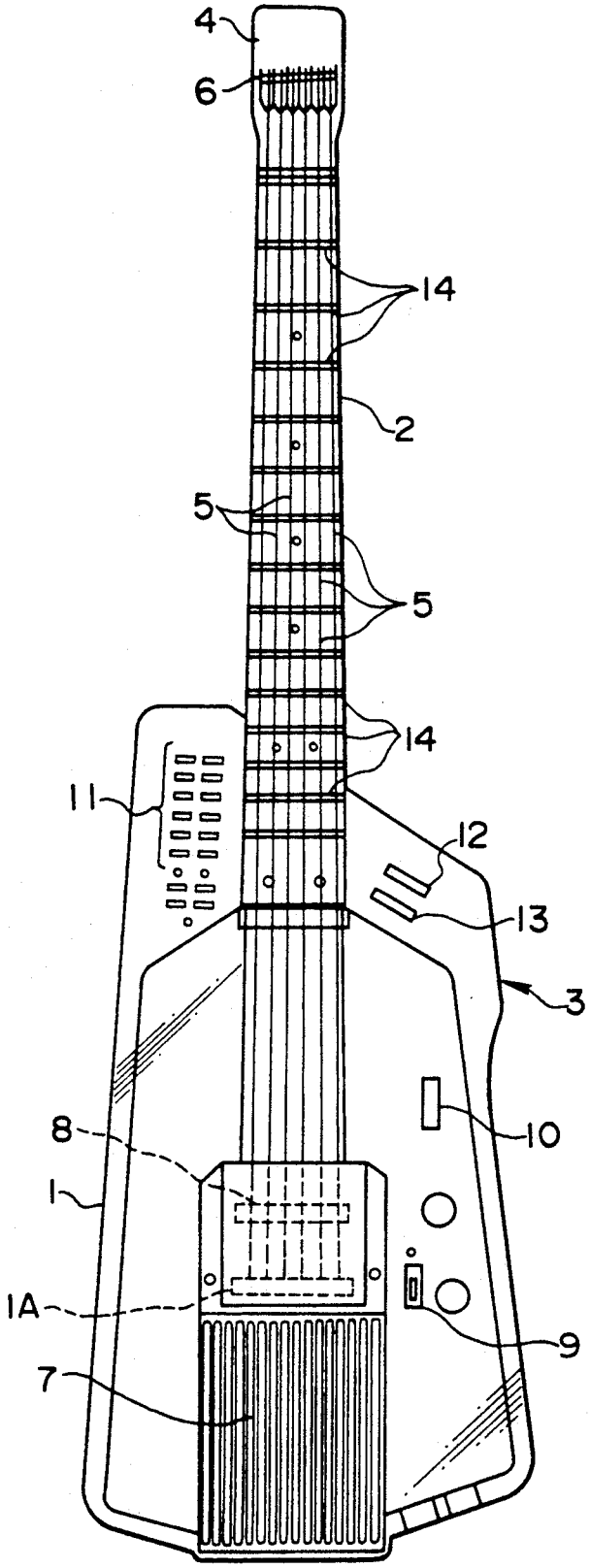
FIG. 1 is a plan view of an electronic stringed musical instrument according to a first embodiment of this invention.

FIG. 1 shows a guitar type electronic stringed musical instrument according to a first embodiment of this invention.

First, the outline of the structure of the electronic stringed musical instrument will be described with reference to FIG. 1.

The electronic stringed musical instrument comprises an instrument body 3 having a body portion 1 and a neck portion 2 both of which are integrally formed with synthetic resin. The material of the body portion 1 and the neck portion 2 of the instrument body 3 is, for example, molding material such as sheet molding compound formed by impregnating a glass fiber-reinforced sheet material with unsaturated polyester resin, or fiber-reinforced foamed material foamed material of epoxy resin, polyester resin, aramid resin, phenolic resin, or the like each of which is reinforced by reinforcing fiber such as carbon short fiber, carbon fiber, plamid fiber, glass fiber, metallic fiber, and the like.

On the upper surface of the instrument body 3, a plurality of strings 5 (six strings) are stretched between the substantial center of the body portion 1 and a head portion 4 formed on the free end of the neck portion 2. One end of each string 5 is fixed to a string support portion 1A provided on the substantial center of the upper surface of the body portion 1, and the other end thereof is connected to a tuning mechanism 6 provided on the head portion 4. On the upper surface of the body 1, a speaker 7, an electromagnetic type pick-up 8 for a string trigger, a power-source switch 9, a mute switch 10, a tone control switch 11, a fill-in switch 12, an automatic rhythm start/stop switch 13 and the like are provided. A plurality of frets 14 are arranged on the upper surface of the neck portion 2.

Figure 2:
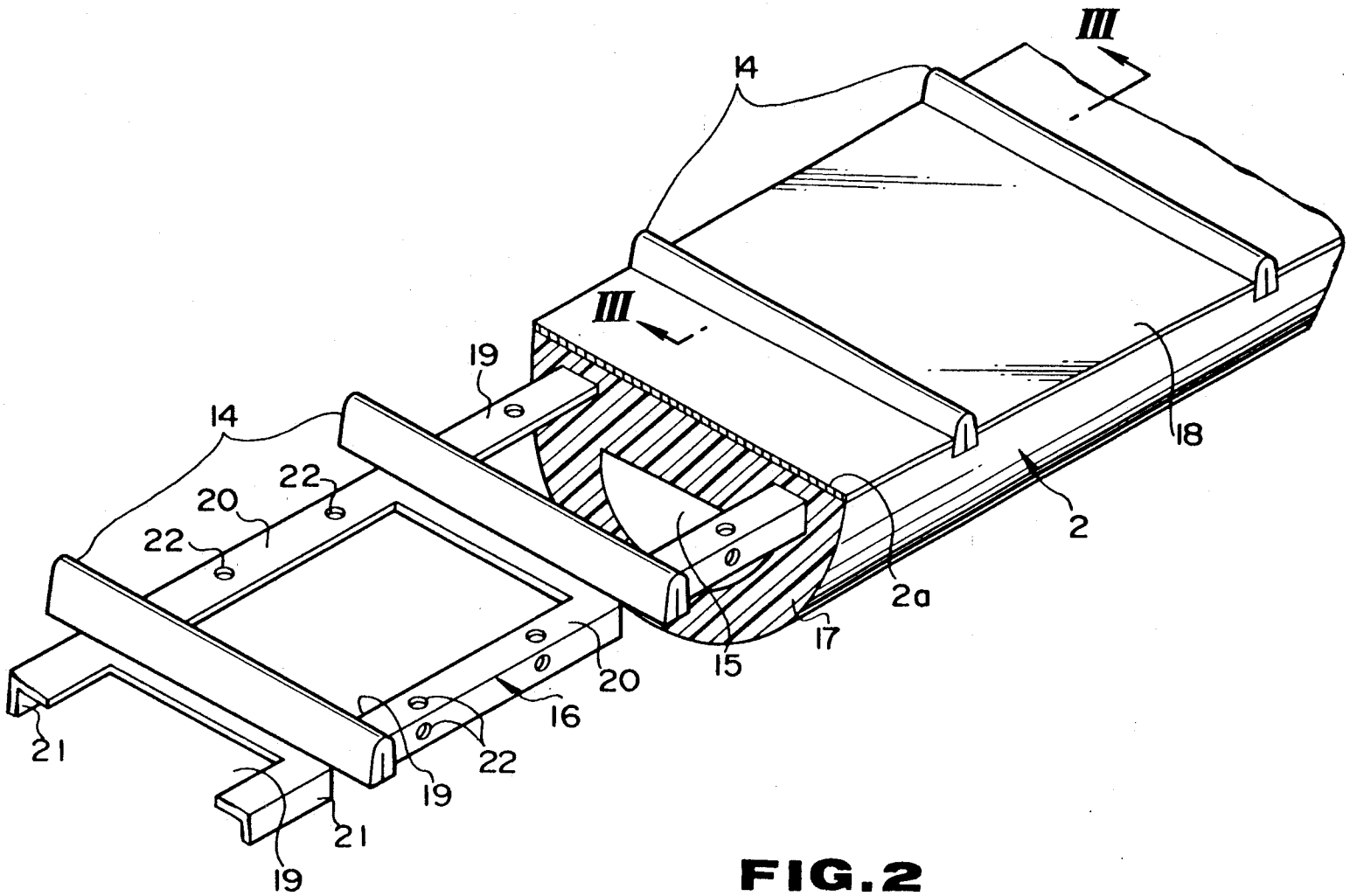
FIG. 2 is a perspective view showing a neck portion of the first embodiment, a part of which is broken.
Figure 3:
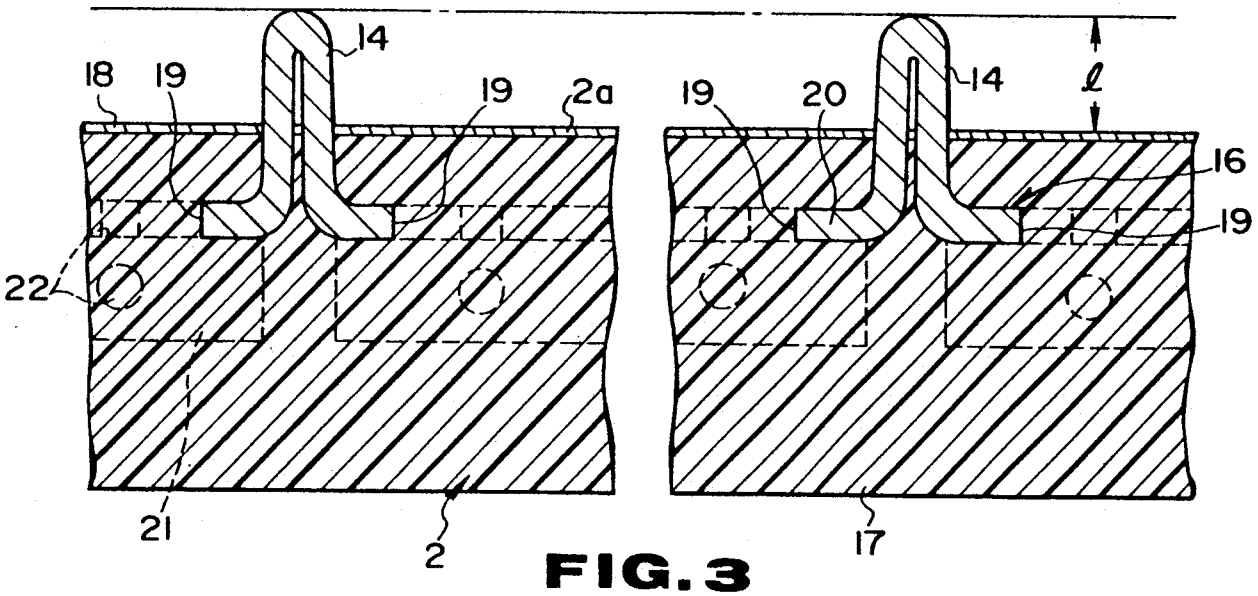
FIG. 3 is a sectional view along line III—III of FIG. 2.

FIGS. 2 and 3 show the neck portion 2 according to the first embodiment.

The neck portion 2 has a semicircular cross-section which is perpendicular to its longitudinal direction, and a semicircular cavity 15 is formed in the central region thereof. A fret structure member 16 constructed by integrally forming a plurality of the above-mentioned frets 14 is embedded in the neck portion 2 so as to be located above the cavity 15 and close to a finger board surface 2*a*. The end base portion of each fret 14 is disposed in a molded resin body 17 which forms the neck portion 2, and the head portion of each fret 14 projects from a decorative sheet 18 which is made of polyester or the like and is adhered on the fingerboard surface 2*a*.

The fret structure member 16 is formed of a metal plate consisting of a belt-like copper plate or a belt-like member stainless steel plate, or hard synthetic resin. Each fret 14 is integrally formed by bending a plate material in an inverted U-shaped. Each horizontal wall portion 20 for connecting the adjacent frets 14 together is provided with vertical support walls 21, which are formed by bending downward both lateral free ends of the horizontal wall portion 20, in order to reinforce the stiffness of the wall portion 20. In the center of the horizontal wall 20 a large rectangular through hole 19 is formed to increase its connecting force to the molded resin body 17 and to reduce the weight of the horizontal wall 20. Further, a plurality of circular engaging holes 22 are formed in the horizontal wall 20 and the vertical support walls 21 so as to increase their connecting force to the molded resin body 17.

The fret structure member 16 is manufactured so as to make the horizontality of the horizontal wall 20 increase and to make the frets 14 have the same height. The horizontal wall 20 is embedded in the molded resin body 17 so as to be parallel to the fingerboard surface 2*a*. Therefore, when the fret structure member 16 is embedded in a predetermined position in the neck portion 2, a plurality of the above-mentioned frets 14 are simultaneously and securely attached on the fingerboard surface 2*a* so as to have the same level (l). Since the stiffness of the neck portion 2 made of synthetic resin is more enhanced by the stiffness of the fret structure member 16 embedded in the neck portion 2, the neck portion 2 is not curved or bent when a tension applied to the strings 5 is increased.

Manufacturing Method

One example of the manufacturing method of the stringed musical instrument according to the first embodiment will be described with reference to FIGS. 4A to 4E.

Figure 4B:
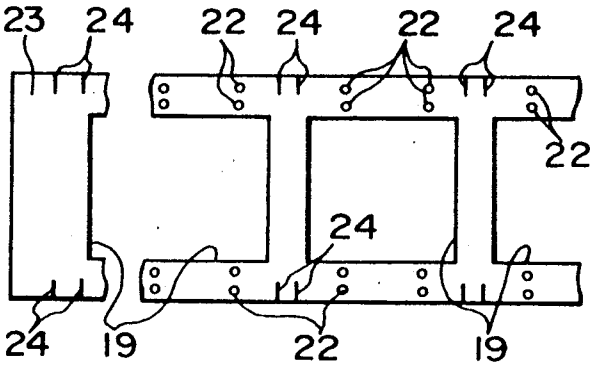
FIGS. 4A to 4E show the manufacturing processes of the stringed musical instrument of the first embodiment.
Figure 4A:
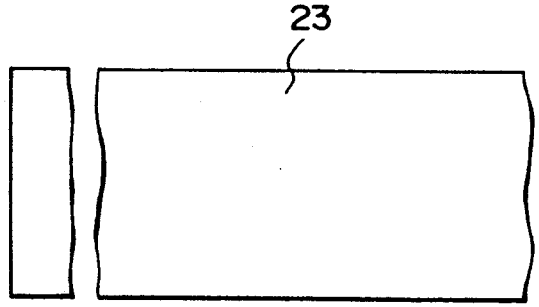
Figure 4C:
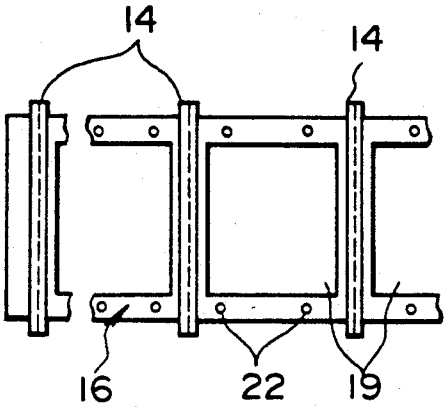
Figure 4D:
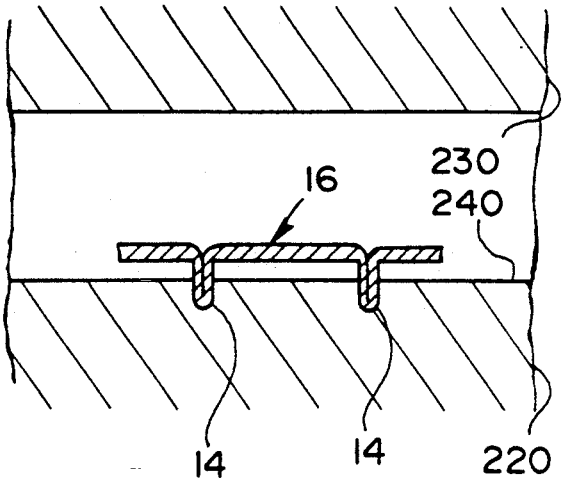
Figure 4E:
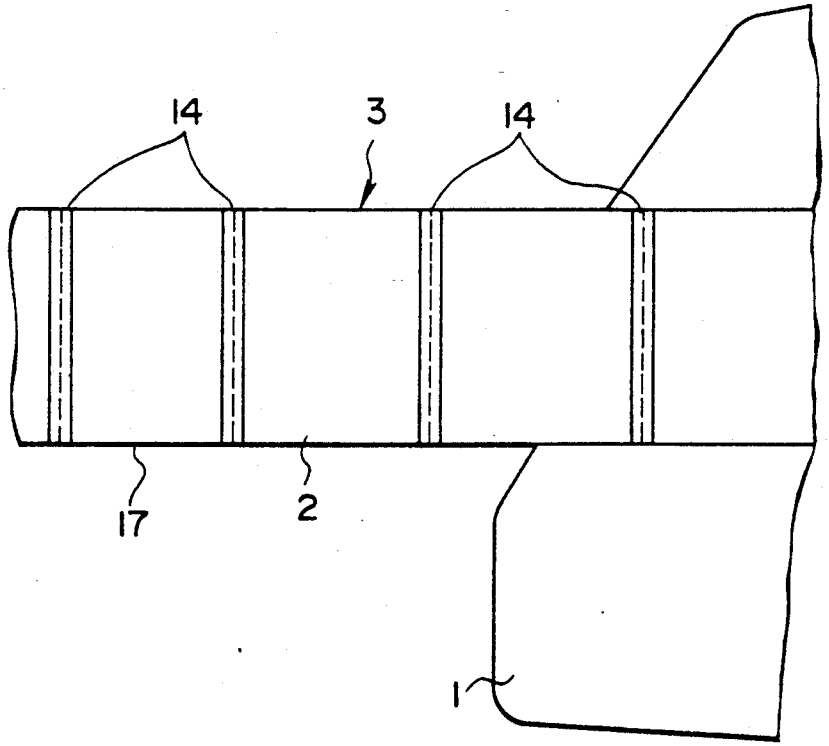

In the first process as shown in FIG. 4A, belt-shaped plate 23 is cut out by means of a shearing machine or the like so as to have predetermined dimensions which is need to constitute the fret structure member 16. Next, in the second process as shown in FIG. 4B, notches 24 for folding the frets 14 through holes 19 and engaging holes 22 are punched out by means of a press or the like at the predetermined positions of the trimmed belt-shaped plate 23. In the third process as shown in FIG. 4C, the punched belt-shaped plate 23 is folded by means of a press or the like to form the frets 14 and the vertical support walls 21, whereby the fret structure member 16 is manufactured. In the fourth process as shown in FIG. 4D, the fret structure member 16 constructed by the above described processes is placed at a predetermined position in a cavity 240 of metallic molds 220 and 230 for forming the neck portion 2, and resin material is injected under pressure in the cavity 240. So that, the fret structure member 16 is embedded in the molded resin body 17 of the neck portion 2. FIG. 4E shows the neck portion 2 in which the fret structure member 16 is integrally molded and which is mounted at the predetermined position on the body 1. In the fourth process as shown in FIG. 4D, the neck portion 2 and the body portion 1 may be integrally formed in each other.

Second Embodiment

Figure 5:
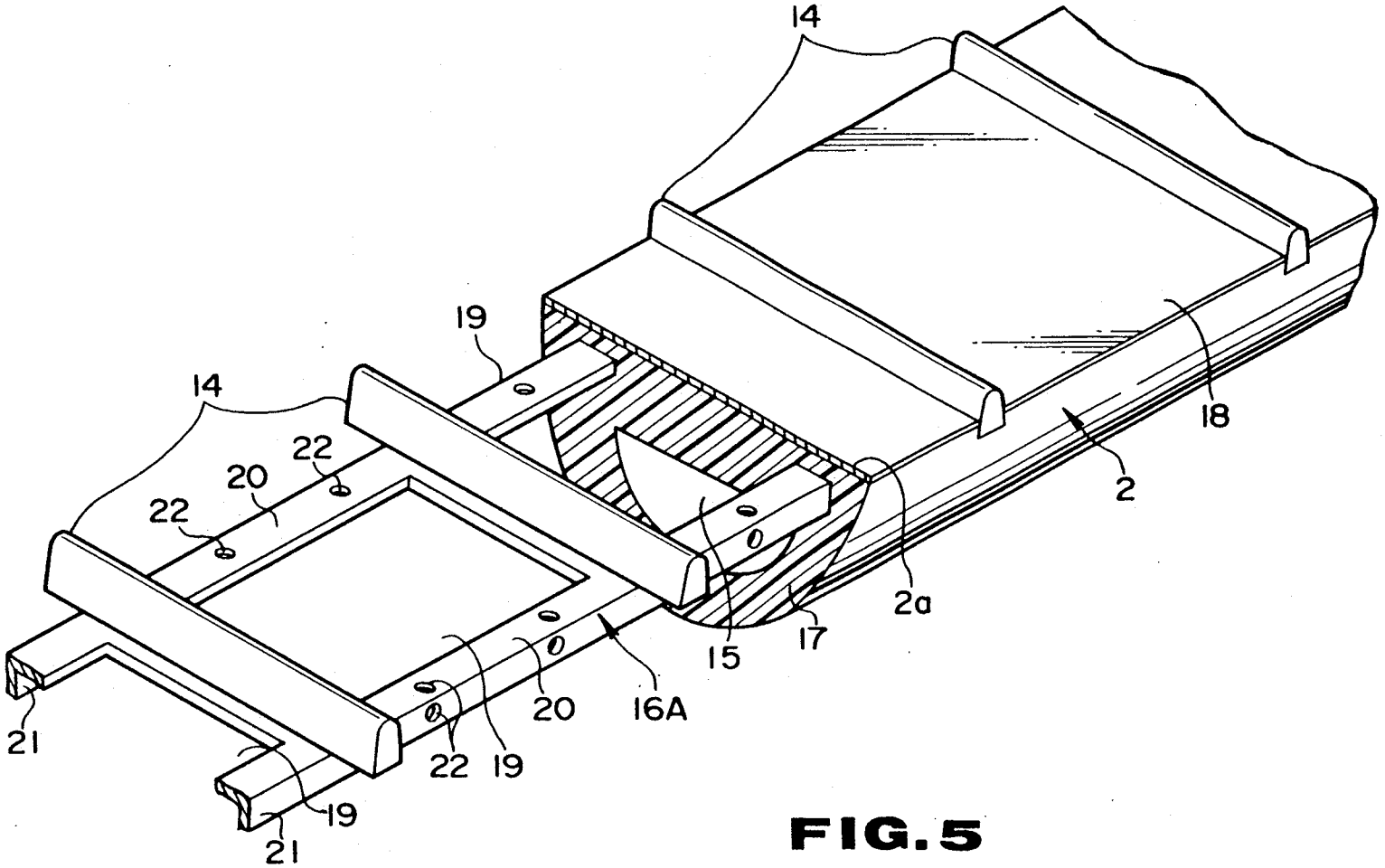
FIG. 5 is a perspective view showing a second embodiment of this invention, in which the fret structure member shown in FIGS. 2 and 3 is replaced with a casted fret member.

The fret structure member 16 of the first embodiment described above is formed by punching and bending a metal plate or a hard synthetic resin plate having a belt shape. In this second embodiment, however, a plurality of frets 14 are integrally formed by casting, as shown in FIG. 5. When a casted fret member 16A is formed by casting, through holes 19 and engaging holes 22 can be formed at the same time. Therefor, manufacture of the casted fret member 16A becomes more easy.

Third Embodiment

Figure 7:
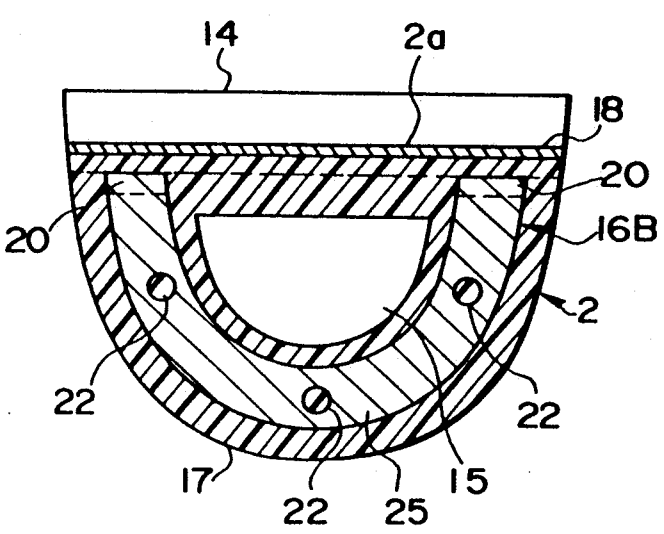
FIG. 7 is a sectional view of a neck portion in which the casted fret member is integrally formed.
Figure 6:
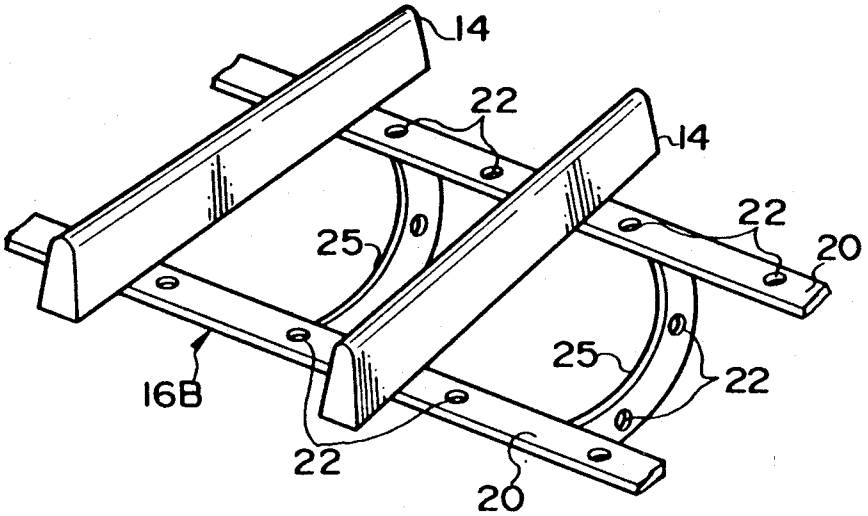
FIG. 6 is a perspective view showing a structure of the casted fret member according to a third embodiment of this invention.

FIGS. 6 and 7 show a third embodiment of this invention. In this embodiment, a plurality of semicircular reinforcing ribs 25 extending along the outer periphery of the neck portion 2 are formed at the predetermined positions on the undersurface of the horizontal walls 20 of a casted fret member 16B. These reinforcing ribs 25 enhance the stiffness of the casted fret structure 16B. With this casted fret member 16B constructed as described above, a higher connecting force for connecting the member 16B to the molded resin body 17 is obtained by the interaction of the reinforcing ribs 25, the horizontal walls 20 and a plurality of engaging holes 22 formed in the reinforcing ribs 25.

Fourth Embodiment

Figure 8:
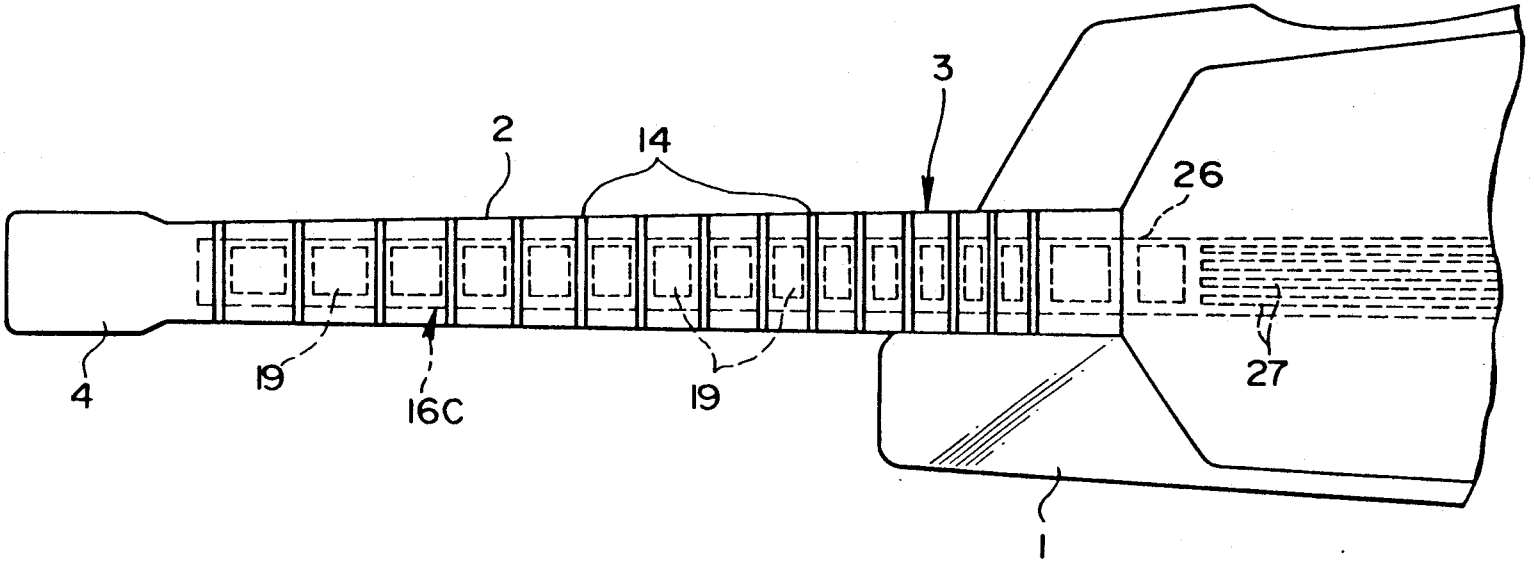
FIG. 8 is a plan view of main parts of a neck portion and a body portion of an electronic stringed musical instrument of a fourth embodiment of this invention.
Figure 9:
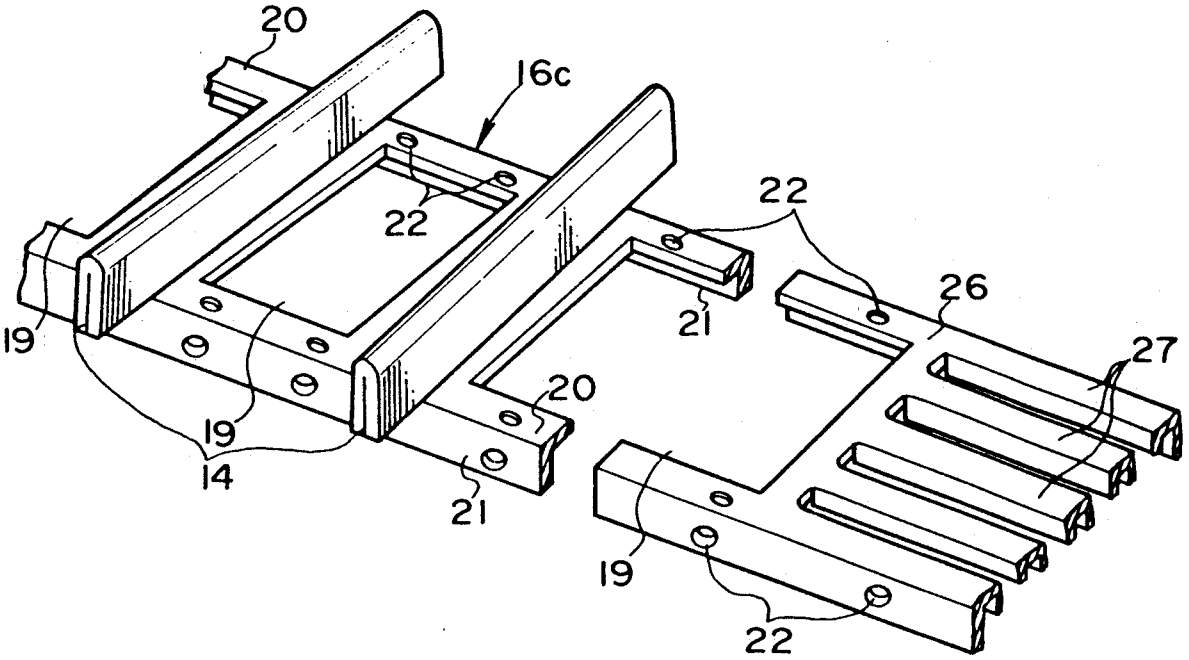
FIG. 9 is a perspective view of a fret structure member used in the fourth embodiment.

FIG. 8 shows a body portion 1 and a neck portion 2, both of which are according to a fourth embodiment of this invention. The structure of the neck portion 2 and a fret structure member 16C embedded therein is fundamentally the same as that shown in FIGS. 2 and 3. In this embodiment, one end of the fret structure member 16C, located adjacent to the body portion 1, extends to the substantial center of the body portion 1, and a plurality of inverted U-shaped reinforcing ribs 27 extending in the longitudinal direction of the fret structure member 16C are formed at this extended end portion 26 (FIG. 9). Like frets 14, the ribs 27 are formed by bending work. That is to say, notches are formed at the predetermined positions in a belt-shaped plate 23 in the second process (the punching process) as shown in FIG. 4B, and then the portions of the fret structure member 16C on which the ribs 27 are to be formed are bent in the third process (the bending process) as shown in FIG. 4C. The formed ribs 27 are shown in FIG. 9.

Since the stiffness of not only the neck portion 2 but also the body portion 1 itself is increased with the so constructed stringed musical instrument 3, the stiffness of the overall stringed musical instrument 3 is enhanced. In contrast to this embodiment, the separately manufactured body portion 1 and neck portion 2 may be combined to form a stringed musical instrument. In this case, the extended end portion 26 of the fret structure member 16C functions as a connecting member for connecting the neck portion 2 to the body portion 1. Therefore, this fret structure member 16C increases a connecting force for connecting the neck portion 2 to the body portion 1.

The manufacturing method of the above described stringed musical instrument is the same as that of the above described first embodiment except for the process of forming the reinforcing ribs 27. Thus, the description of the manufacturing method is omitted.

By the way, the extended end portion 26 of the fret structure member 16C is not embedded in a molded resin body 17 forming the neck portion 2, which is disposed in the body portion formation region in the cavity of metallic mold.

Fifth Embodiment

Figure 10:
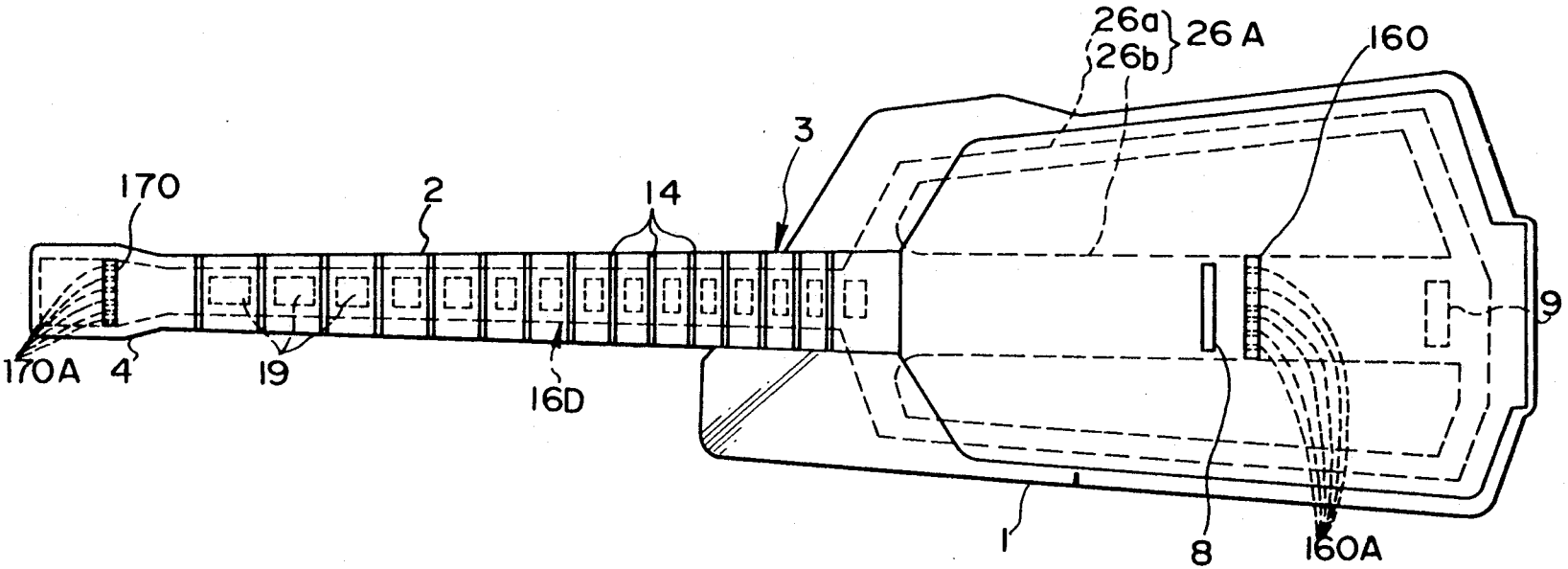
FIG. 10 is a plan view of a stringed musical instrument according to a fifth embodiment of this invention.
Figure 11:
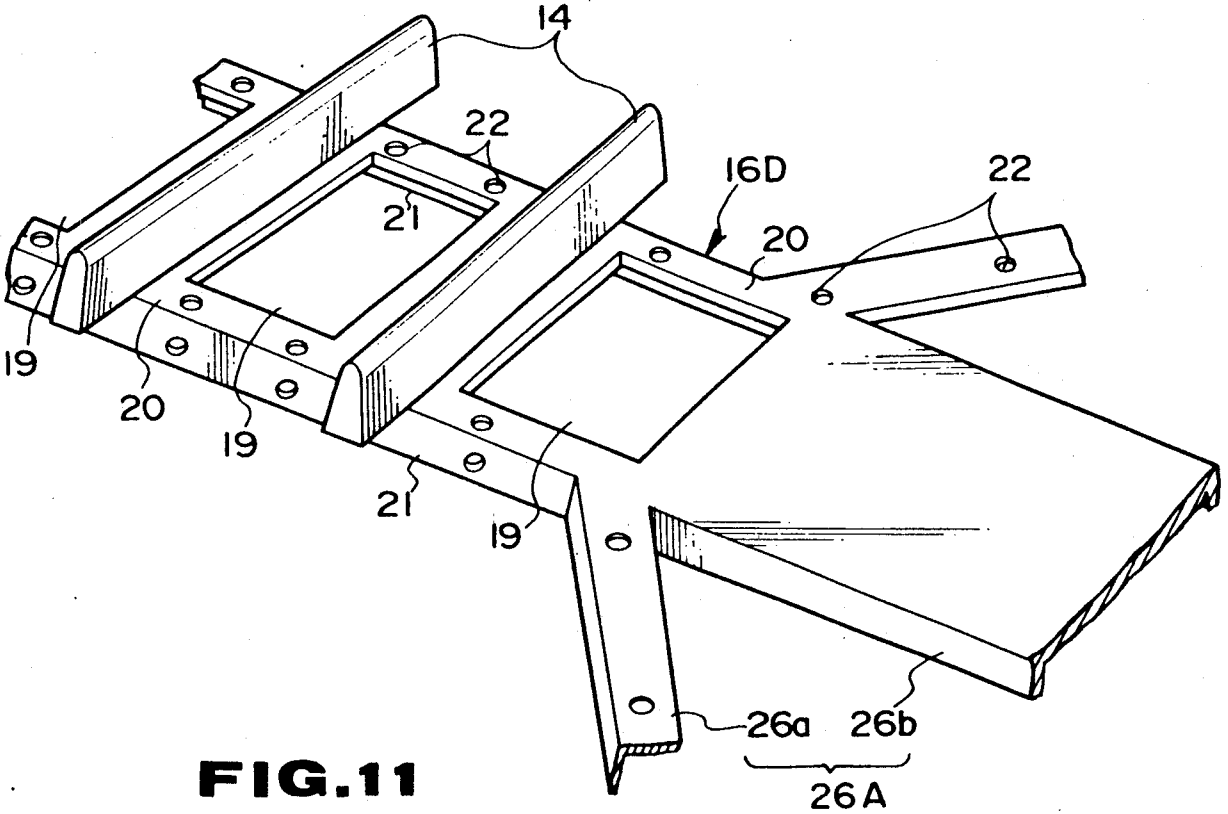
FIG. 11 is a perspective view showing a casted fret member used in the fifth embodiment, a part of which is cut away.

FIGS. 10 and 11 show a casted fret member 16D according to a fifth embodiment. In this fifth embodiment one end portion of the casted fret member 16D extends in a body portion 1. The extended end portion 26A is constructed by an annular member **26*a* extending along the peripheral shape of the body 1 and a bridge member 26*b* crossing the central space of the annular member 26*a*. On the bridge member 26*b*, a string support portion 160, to which one end of each string to be stretched is fixed, is integrally formed to project. String holes 160A into each of which one end of each string is inserted are formed in the string support portion 160. On the other end portion of the casted fret member 16D, another string support member 170, to which the other end of each string is fixed, is integrally formed to project. String holes 170A, into each of which the other end of each string is inserted, are also formed in the string support member 170**.

In this embodiment, since the extended end portion 26A extends over almost all region in the body portion 1, the stiffness of the body portion 1 is more increased. Further, since the casted fret member 16D is provided in both the body portion 1 and the neck portion 2, unification between two portions 1 and 2 is more increased. Still further, since the string support portion 160 and the string support member 170 are integrally formed on both ends of the casted fret member 16D, the neck portion 2 is not bent even when the strings are stretched under a high tension. The extended end portion 26A can be used as a fixing base to which various parts, such as a power source switch 9 and a pick-up 8, are fixed.

Sixth Embodiment

Figure 12:
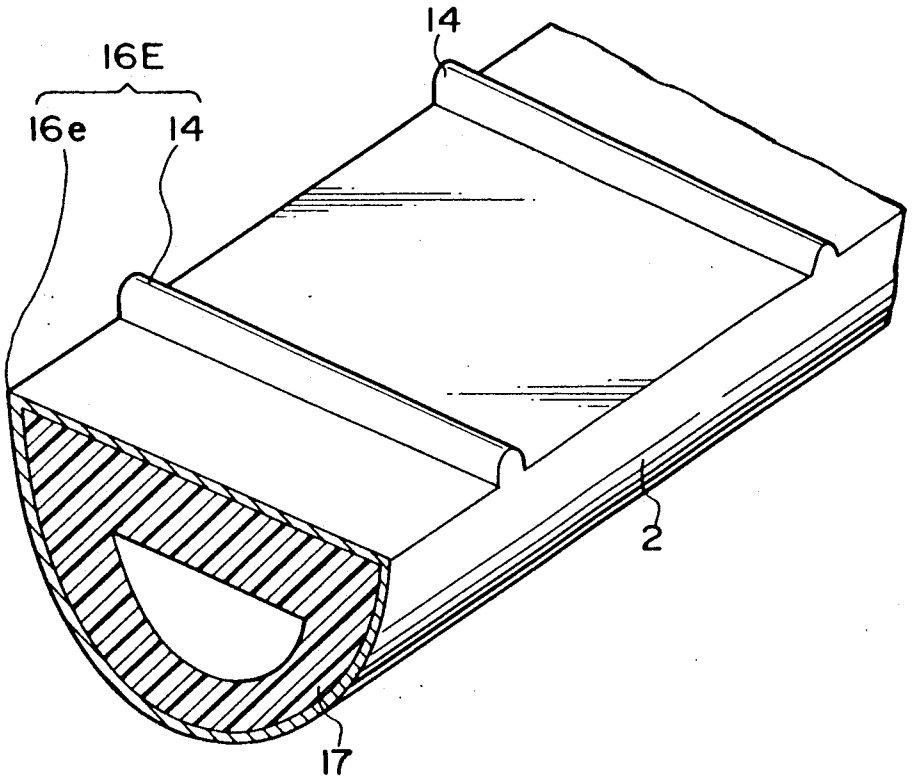
FIG. 12 is a perspective view showing a neck portion according to a sixth embodiment of this invention, a part of which is cut away.

FIG. 12 shows a neck member according to a sixth embodiment.

The neck member of this sixth embodiment is constructed by integrally forming a cylindrical fret structure member 16E on the outer periphery of a molded resin body 17 forming a neck portion 2. The fret structure member 16E has a cylindrical portion 16E formed on the outer periphery of the molded resin body 17, and a plurality of frets 14. They are integrally made of metallic material or fiber (such as carbon fiber or glass fiber) reinforced composite material.

The unification of the molded resin body 17 and the fret structure member 16E is obtained by so-called the insert molding method or the outset molding method, or by attaching the cylindrical fret structure member 16E to the outer periphery of the molded resin body 17 by means of an adhesive.

Although this construction is very simple, the overall neck portion 2 has a high toughness and a high strength. Therefor, the neck portion 2 is prevented from curving or bending due to the tension of the strings. Further, it is unnecessary to use an adjusting rod or the like for compensating the curving of the neck portion 2.

Seventh Embodiment

Figure 13:
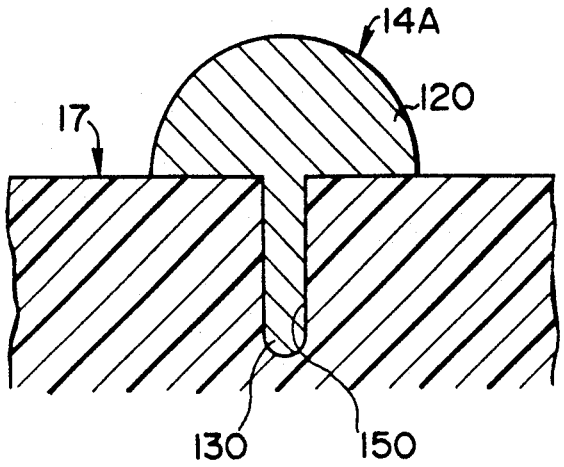
FIG. 13 is a sectional view of a main part of a seventh embodiment of this invention.

FIG. 13 shows the main part of a seventh embodiment.

Each fret 14A is made of metallic material such as stainless steel or hard synthetic resin material. It is constructed by a head portion 120 having a substantially semicircular cross section, and a flat plate like base portion 130 which extends on the center of the flat undersurface of the head portion 120 over the whole length of the fret 14A and projects downward from the undersurface of the head portion 120.

A fingerboard 17 which constitutes a molded resin body is made to have a belt shape of compression molding composition such as FRP (fiber-reinforced plastics) which is made by adding reinforcing material such as glass fiber to synthetic resin such as phenol resin or epoxy resin and, or injection molding composition such as PPS (polyphenilen sulfide) or PET (polyethylene terephtalate).

Figure 14:
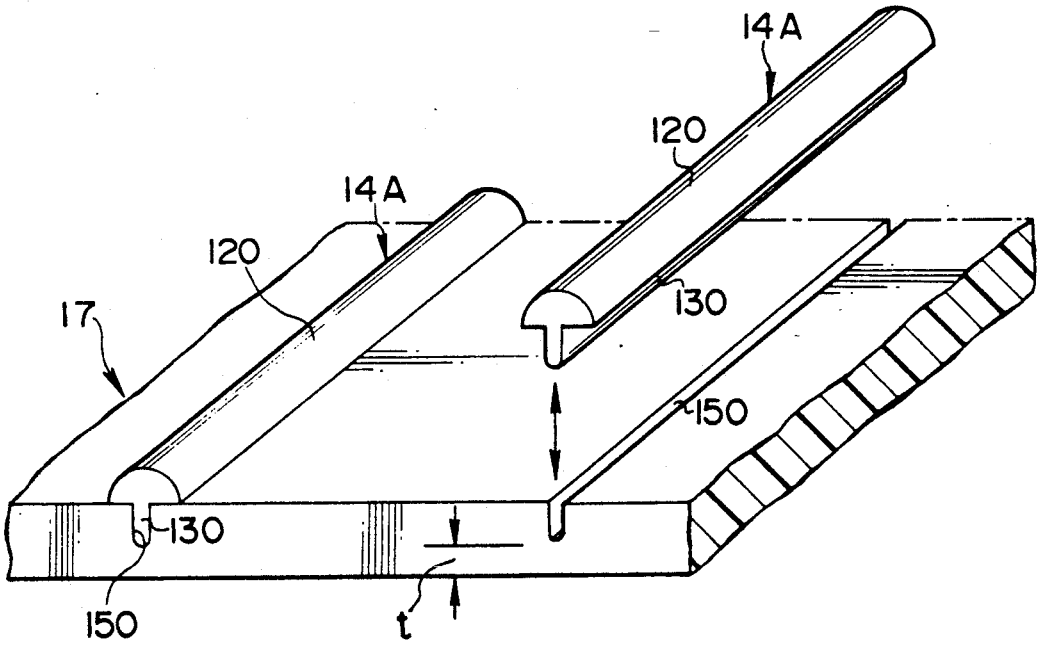
FIG. 14 is an exploded perspective view of a fingerboard construction body of a seventh embodiment.

As shown in FIG. 14, a plurality of fret grooves 150 are formed in the fingerboard 17 so as to be located at a predetermined intervals in the lengthwise direction of the fingerboard 17 to extend in the crosswise direction thereof, and the plate-like base end portion 130 of each fret 14A is forcibly fitted in the corresponding fret groove 150.

The fixing of the frets 14A to the fingerboard 17 is carried out by a surface contact between the surface of the base end portions 130 of the frets 14A and the corresponding fret grooves 150 in the fingerboard 17. Since the contact area of the frets 14A for fixing the frets 14A to the fingerboard 17 is large, the frets 14A are not easily removed from the fingerboard 17.

When the fingerboard 17 is made of synthetic resin, the base end portions 130 of the frets 14A are insert-molded in the fingerboard 17. Thus, the force which broadens the fret grooves 150 is not exerted on the fingerboard 17, and the whole fingerboard 17 is not curved or bent due to this broadening force. Since all the base end portions 130 of the frets 14A can be simultaneously embedded in the fingerboard 17 when the fingerboard 17 is made of synthetic resin, the fingerboard with the frets is easily manufactured for a short time. As the base portions 130 of the frets 14A can be evenly embedded in the fingerboard 17 when the fingerboard 17 is made of synthetic resin, the height of the head portions 120 of the frets 14A from the upper surface of the fingerboard 17, and the contact area of the frets 14A to the fingerboard 17 can be constant.

One example of a manufacturing method for manufacturing the fingerboard construction member of the above described construction will be described with reference to FIGS. 15A to 15C.

Figure 15A:
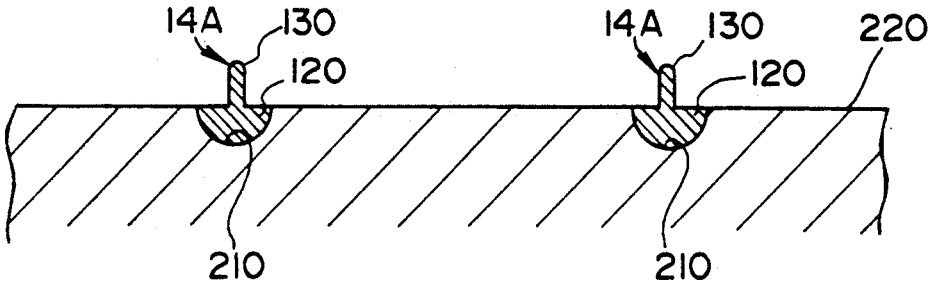
FIGS. 15A to 15C show the manufacturing processes of the fingerboard construction body of the seventh embodiment.
Figure 15B:
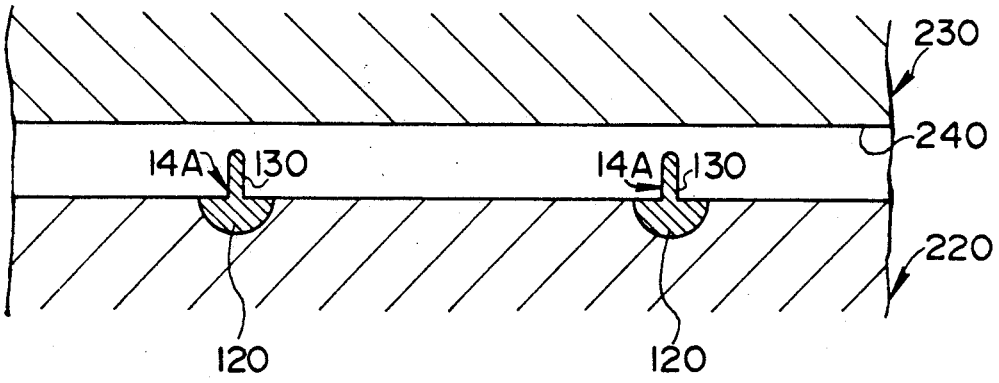
Figure 15C:
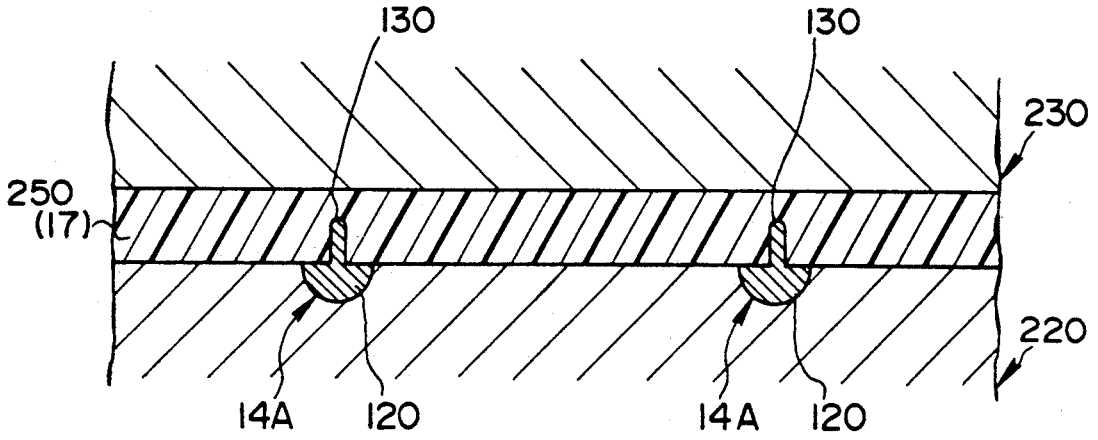

As shown in FIG. 15A a lower metallic mold 220, in which a plurality of recesses 210 each having a substantially semicircular cross section complimentary to the outer shape of the head portion 120 of each fret 14A are formed in the same plane at predetermined intervals, is prepared. The head portions of the frets 14A are placed in the recesses 210. As shown FIG. 15B, an upper metallic mold 230 is lowered to approach the lower metallic mold 220, and a cavity 240 for molding a fingerboard is defined between both the molds 220 and 230. Then, the above described injection molding compound 250 which is heated and has been liquefied is instantaneously injected in the cavity 240 and is hardened. Finally, the upper metallic mold 230 is lifted to open the molds, and the fingerboard 17 with the frets 14A are manufactured. When the fingerboard 17 is compression-molded from compression molding compound, the above described fingerboard 17 with the frets 14A can be obtained.

With this manufacturing method, the base end portions 130 of the frets 14A are insert-molded in the fingerboard 17 only by forming the fingerboard 17 from resin material in the metallic molds after the frets 14A have been arranged in the lower metallic mold 220. Accordingly, the frets 14A can be accurately arranged on the fingerboard 17, and the height of the head portions 120 of the frets 14A on the fingerboard 17 can be made constant. As a result, products of constant quality can be easily manufactured.

Eighth Embodiment

Figure 16:
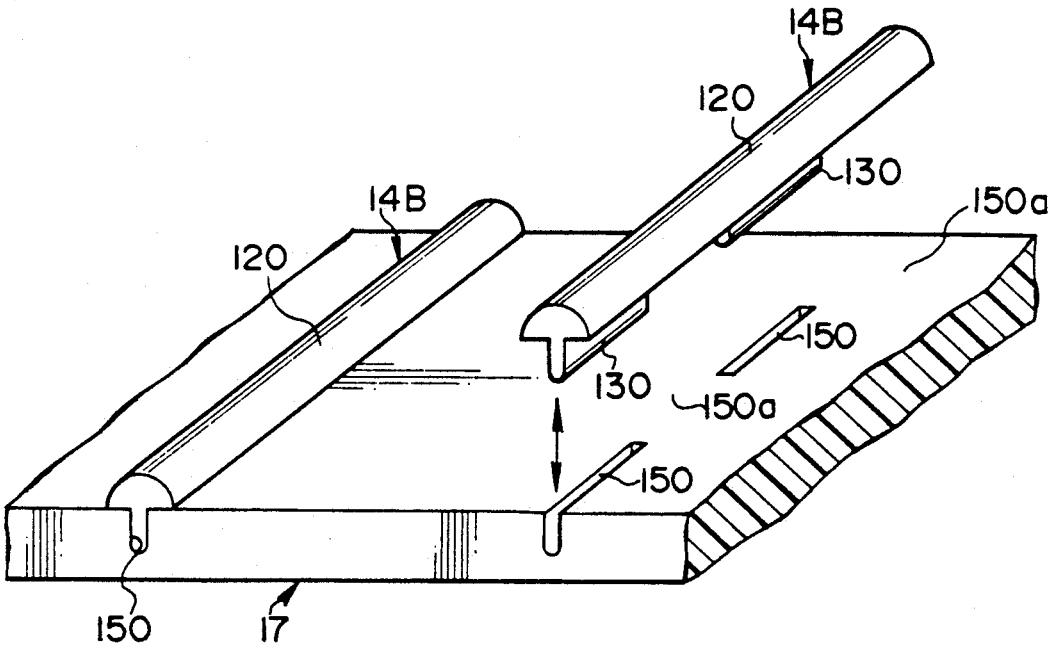
FIG. 16 is an exploded perspective view of the main part of an eighth embodiment of this invention.

FIG. 16 shows the main part of an eighth embodiment.

Since the base end portion 130 of each fret 14A extends over the whole length of the fret 14A in the above described seventh embodiment, each fret groove 150 also extends over the whole length of the width of the fingerboard 17. Thus, the portions of the fingerboard 17 which the fret grooves 150 are formed (the thickness of each groove-formed portion is shown by "t" in FIG. 14) are much thinner than the other portions of the fingerboard 17, so that the strength of each groove-formed portion is weakened.

As shown in FIG. 16, with the eighth embodiment, each fret 14B is provided with a plurality of base end portions 130 arranged in tandem at intervals.

With this construction, a plurality of fret grooves 150 for each fret 14B are formed in tandem at intervals in the crosswise direction of the fingerboard 17, whereby the flat portions 150*a* between the adjacent fret grooves 150 in each row elevate the strength of each groove-formed portion of the fingerboard 17.

Ninth Embodiment

Figure 17A:
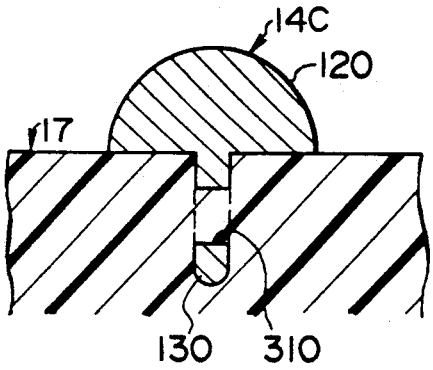
FIGS. 17A, 17B, 18A and 18B are sectional views respectively showing the main parts of ninth to twelfth embodiments of this invention.

FIG. 17A shows the main part of a ninth embodiment.

In this embodiment, the connecting force of each fret 14C to the fingerboard 17 is strengthen. A plurality of engaging holes 310 having a rectangular, circular or triangular shape or the other shape at intervals is formed on each fret 14C. When the fingerboard 17 is made of synthetic resin material, part of the synthetic resin material is filled in the engaging holes 310 such that the frets 14C are firmly fixed to the fingerboard 17.

Tenth Embodiment

Figure 17B:
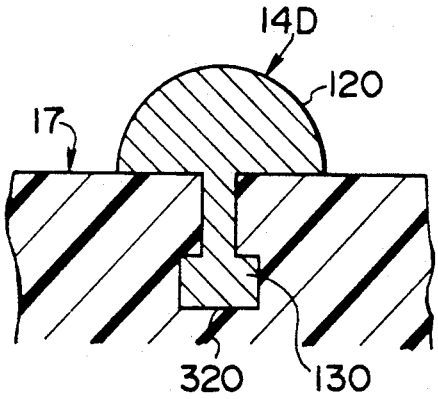

FIG. 17B shows the main part of a tenth embodiment.

In this embodiment, the connecting force of each fret 140 to the fingerboard 17 is strengthen. The free end of the base end portion 130 of each fret 14D is provided with projection 320 for preventing the base end portion 130 from being removed from the fingerboard 17. The projections 130 firmly fix the frets 14D to the fingerboard 17.

Eleventh Embodiment

Figure 18A:
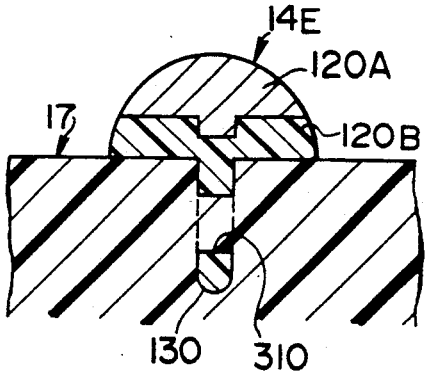

FIG. 18A shows an eleventh embodiment.

Each fret 14E is made of two kinds of material having different hardness. The upper fret construction member 120A which is in contact with strings is made of hard material, and the lower fret construction member 120B which is embedded in the fingerboard 17 is made of soft material. It is preferred that the upper fret construction member 120A is formed of a material having Rockwell hardness of at least HRC 40 such as ceramics or metal, and the lower fret construction member 10B is made of a material having Rockwell hardness of at most HRC 20 such as thermoplastic resin, cow bones, ivory.

Since the upper fret portion 120A is made of hard material such as metal or the like, its abrasion by the strings is small. When the strings are in sliding contact with the upper fret construction member 120A at the time of tuning the strings or at the time of operating the tremolo arm, smooth sliding of the strings is ensured.

On the other hand, since the lower fret construction member 120B is made of soft material, workability of it is good. Therefore, the user of the stringed musical instrument can easily shave the upper portion of the lower fret construction member 120B to change the height of the fret 14E according to his preference.

Further, the transmission characteristic of the vibration of the strings can be varied by changing the material of the fret construction members 120A and 120B, so that the required acoustic characteristic is obtained.

Twelfth Embodiment

Figure 18B:
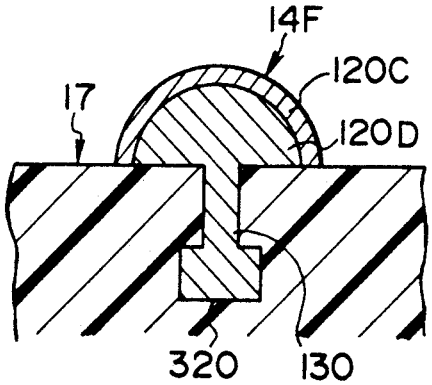

With a twelfth embodiment shown in FIG. 18B, each fret 14F is made of electrically resistive material and electrically conductive material. That is, an upper resistive fret construction member 120C which is in contact with strings is made of thin electrically resistive material such as ruthenium. A lower conductive fret construction member 120D, which is embedded at its base end portion 130 in a fingerboard 17 and is covered at its upper surface with the upper resistive fret construction member 120C, is made of electrically conductive material such as iron or copper.

With this structure, the electrical contacting positions between the strings and the frets can be detected by applying a voltage on the strings or the lower conductive fret construction member 120D in turn. Accordingly, a fret operating position detecting device for detecting the string-pushing positions o the basis of above detection can be effectively used in the stringed musical instrument. Such a detecting device is described in U.S. Patent Application Ser. No. 354,131 (Inventors: Shigeru UCHIYAMA, Yoshiyuki MURATA) which was filed on May 19, 1989 and assigned to the assignee of this invention.

Thirteenth Embodiment

Figure 19:
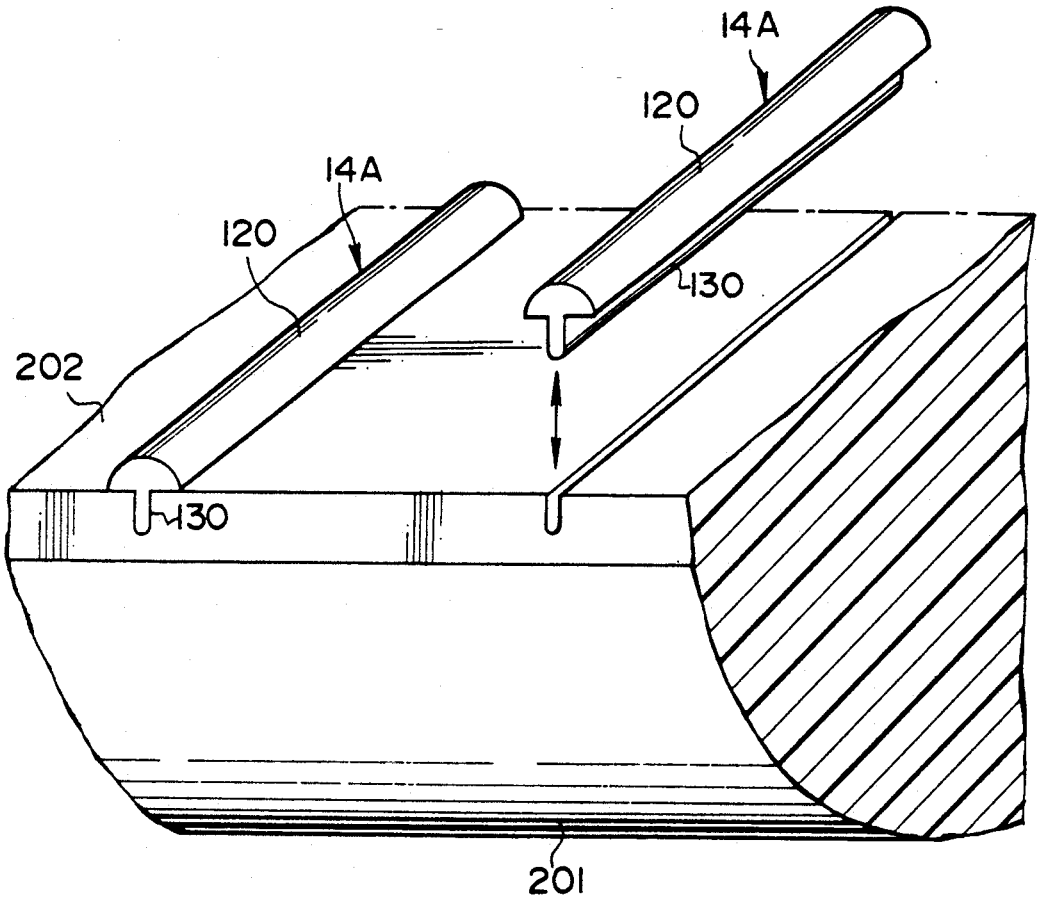
FIG. 19 is an exploded perspective view of the main part of a thirteenth embodiment.

FIG. 19 shows the main part of a thirteenth embodiment.

A neck 201 made of synthetic resin also serves as a fingerboard. The base end portions 130 of a plurality of frets 14A are insert-molded at predetermined intervals on the fingerboard surface 202 of the neck 201.

Therefore, also in this embodiment, like the fingerboard structure member as described above, the frets 14A can be fixed to the fingerboard surface 202 of the neck 201. Since the frets 14A are insert-molded on the neck 201, the neck 201 is prevented from being curved or bent, and the frets 14A can be fixed to the fingerboard surface 202 of the neck 201 at the same height.

The manufacturing method of this neck structure member is the same as that of the above described fingerboard structure member, except that the cavity of metallic molds is shaped complimentarily to the outer shape of the neck 201. Thus, the detailed description of the manufacturing method is omitted.

Fourteenth Embodiment

Figure 20:
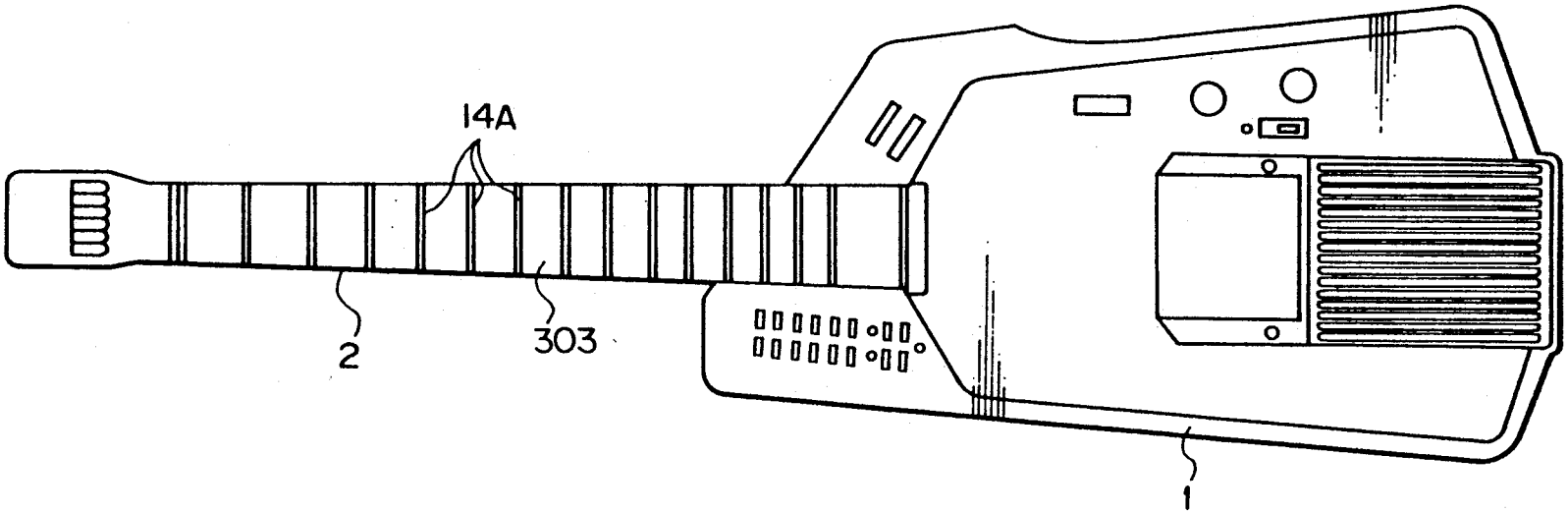
FIG. 20 is a view showing the outside appearance of a fourteenth embodiment of this invention.

FIG. 20 shows the outside appearance of a fourteenth embodiment of this invention.

With this stringed musical instrument, a body portion 1 and a neck portion 2 projecting therefrom are integrally formed of synthetic resin. In the fingerboard surface 303 of the neck portion 2 the base end portions (not shown) of a plurality of frets 14A having the same structure of the frets 14A shown in FIG. 14 are insert-molded, so as to be arranged at predetermined intervals.

Accordingly, in this stringed musical instrument, like the above described fingerboard structure member, the frets 14A are securely fixed to the fingerboard surface 303 of the neck portion 2, no curving or bending occurs in the neck portion 2, and the frets 14A are fixed to the fingerboard surface 303 of the neck portion 2 at the same height.

The manufacturing method of this stringed musical instrument is the same as that of the manufacturing method of the fingerboard structure member except that the cavity of the metallic molds has the complimentary shape to those of the body portion 1 and the neck portion 2.

Thus, the detailed description of the manufacturing method is omitted.

Fifteenth Embodiment

Figure 21:
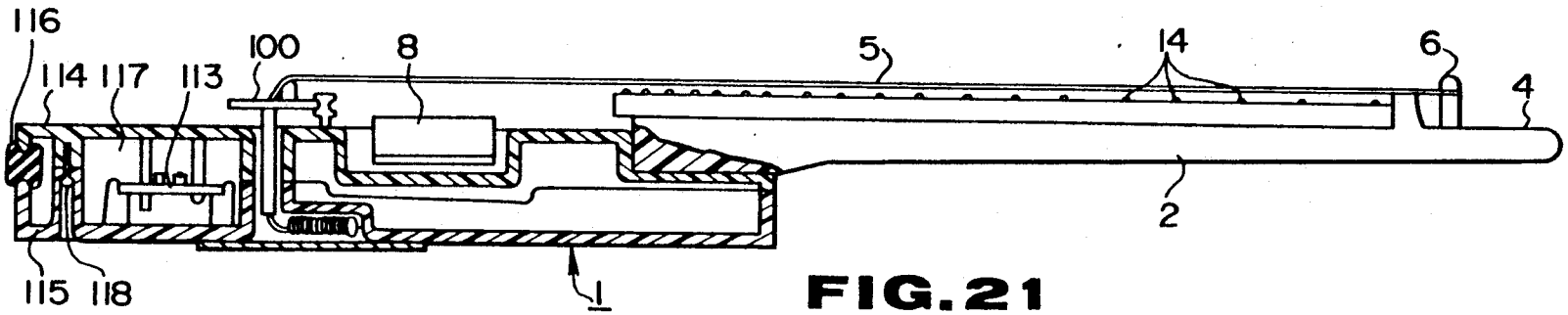
FIG. 21 is a longitudinally sectional view along the longitudinal central line of an electronic stringed musical instrument of a fifteenth embodiment of this invention.

FIG. 21 shows an electronic stringed musical instrument according to a fifteenth embodiment. The same parts and elements as those used in the first embodiment in FIG. 1 are designated by the same referential numerals as those used in the first embodiment in FIG. 1, the description thereof being omitted.

As shown in FIG. 21, within a body portion 1 is provided electronic parts 113 which controls a musical sound generator so as to start the generation of musical sounds due to output signals from a pick-up 8. The body portion 1 is constructed by an upper half body 114 covering the upper portion of the electronic part 113 and a lower half body 115 covering the lower portion of the electronic parts 113. The upper and lower half bodies 114 and 115 are seated together at their outer peripheral ribs 19A and 20A to form a box.

The seating surfaces of the outer peripheral ribs 19A and 20A of the upper and lower half bodies 114 and 115 sandwiches a packing member 116 extending over the whole length of the peripheral surface of the body portion. The packing member 116 is made of soft synthetic resin such as soft vinyl chloride resin in this embodiment. However, it may be made of other very soft material such as soft urethane, natural rubber or silicone rubber.

Figure 22C:
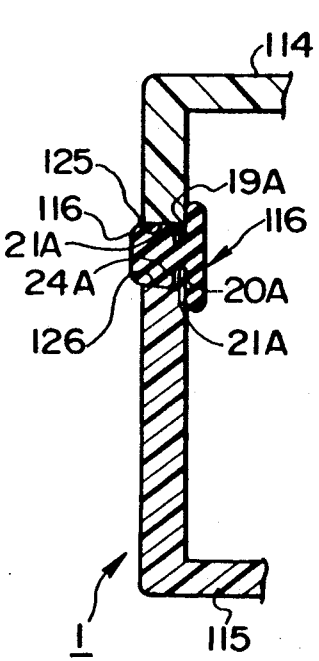
FIGS. 22A to 22C are enlarged sectional views showing embodiments of body portions and packing members.
Figure 22B:
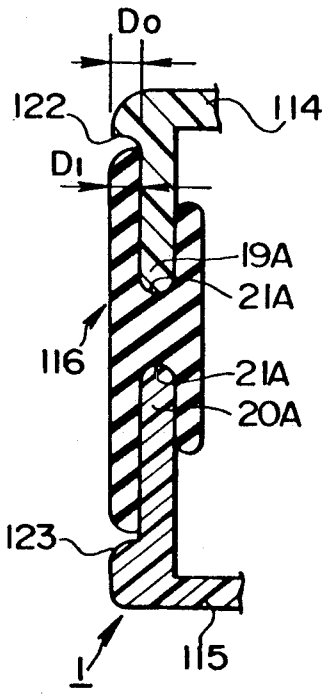
Figure 22A:
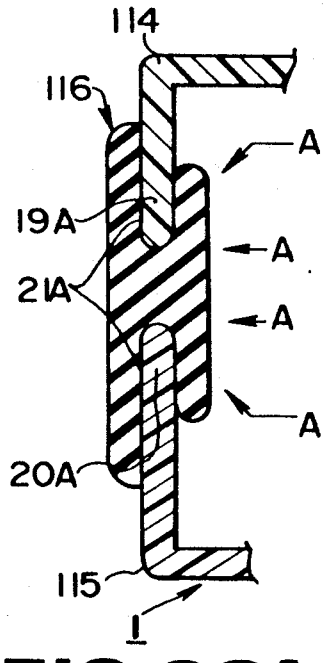

As shown in FIG. 22A, the packing member 116 has an H-shaped cross section. In upper and lower fitting grooves 21A formed in the upper and lower end surfaces of the packing member 116, the outer peripheral rib 19A of the upper half body 114 and the outer peripheral rib 20A of the lower half body 115 are forcibly fitted.

Nosings 122 and 123, which are formed, as shown in FIG. 22B, on the upper portion of the outer peripheral rib 19A of the upper half body 114 and the lower portion of the outer peripheral rib 20A of the lower half body 115, can prevent the packing member 116 from projecting out from the outer peripheral surface of the body portion 1. In this case, the projected distance $D_0$ of the nosings 122 and 123 is equal to the projecting thickness $D_1$ of the packing member 116 from the outer peripheral surface of the body portion 1.

Cross section of the packing member 116 may be a cross section of a general rail road. In this case, the outer peripheral ribs 19A of the upper half body 114 and the outer peripheral ribs 20A of the lower half body 115 are forcibly fitted in the fitting grooves 124 so as to locate the broad width portion of the cross section at the inner peripheral surface side of the body portion 1 and to locate the thin width portion of the cross section at the outer peripheral surface side of the body portion 1.

Further, in this case, when recesses 125 and 126 are formed in the projected end portions of the outer peripheral rib 19A of the upper half body 114 and the outer peripheral rib 20A of the lower half body 115 so as to be indented inwardly from the outer peripheral surface as shown in FIG. 22C, the area of the packing member 116 which is exposed at the outer peripheral surface of the body portion 1 is reduced. In this case, those projecting end portions of the outer peripheral ribs 19A and 20A, in which the recesses 125 and 126 are mounted, are fitted in fitting grooves 24A in the upper and lower end surfaces of the packing member 116.

Figure 24:
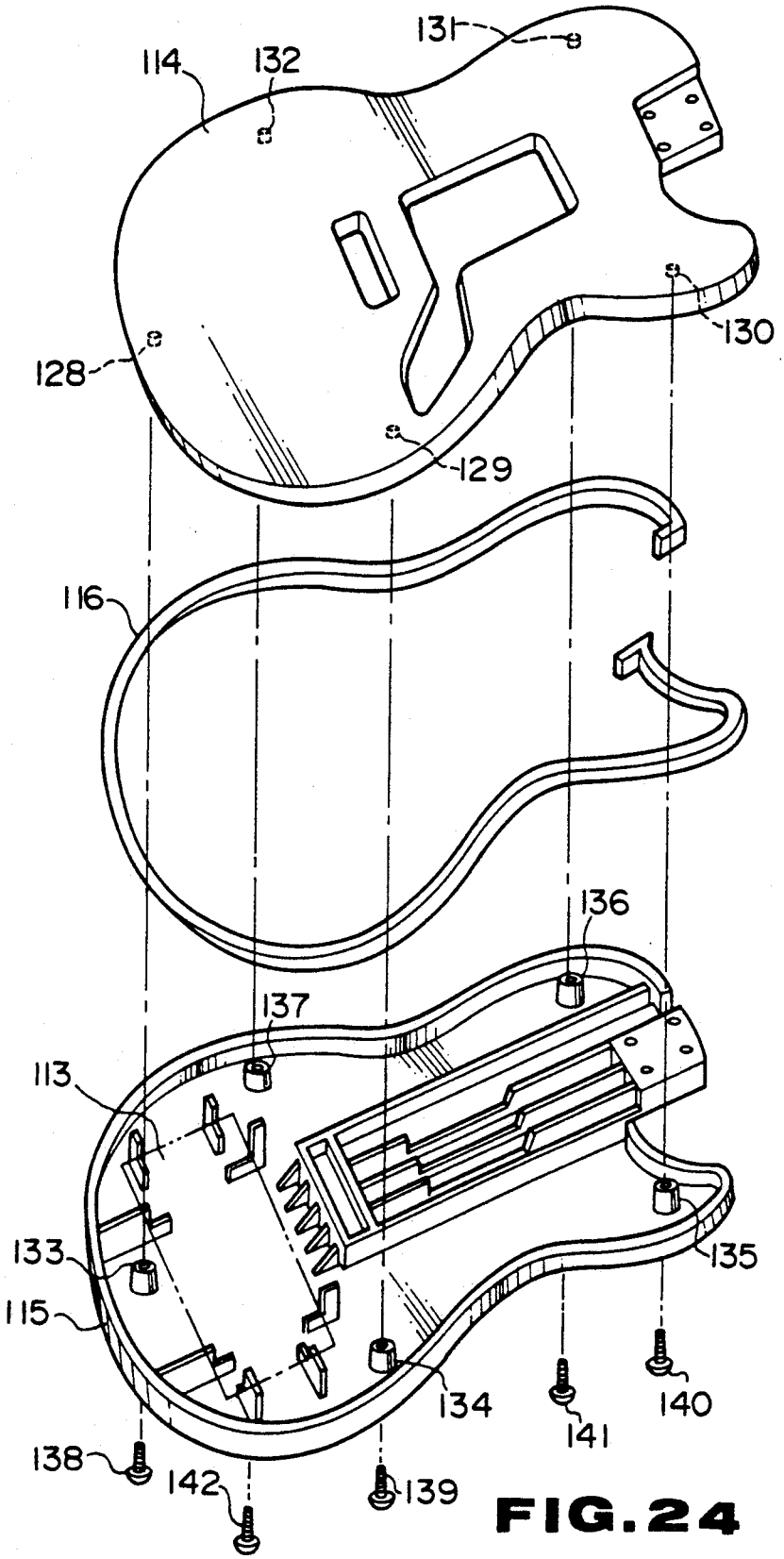
FIG. 24 is an exploded perspective view of a body portion of the electronic stringed musical instrument shown in FIG. 1.

As shown in FIG. 24, bosses 128, 129, 130, 131 and 132 are integrally formed on the inner plane of the upper half body 114. On the inner plane of the lower half body 115, bosses 133, 134, 135, 136 and 137 are integrally formed so as to be arranged in alignment with the bosses 128 to 132 of the upper half body 114.

Screws 138, 139, 140, 141, and 142 are housed in indentations formed on the outer plane of the lower half body 115 so as to correspond to the bosses 133, 134, 135, 136, and 137, and screwed on the bosses 128, 129, 130, 131, and 132 of the upper half body 114. Fixing means are constructed by the bosses 128, 129, 130, 131, 132, 133, 134, 135, 136 and 137, and the screws 138, 139, 140, 141 and 142. As apparent from the above description, the upper and lower half bodies 114 and 115 are connected together by means of the screws 138 to 142.

Figure 23:
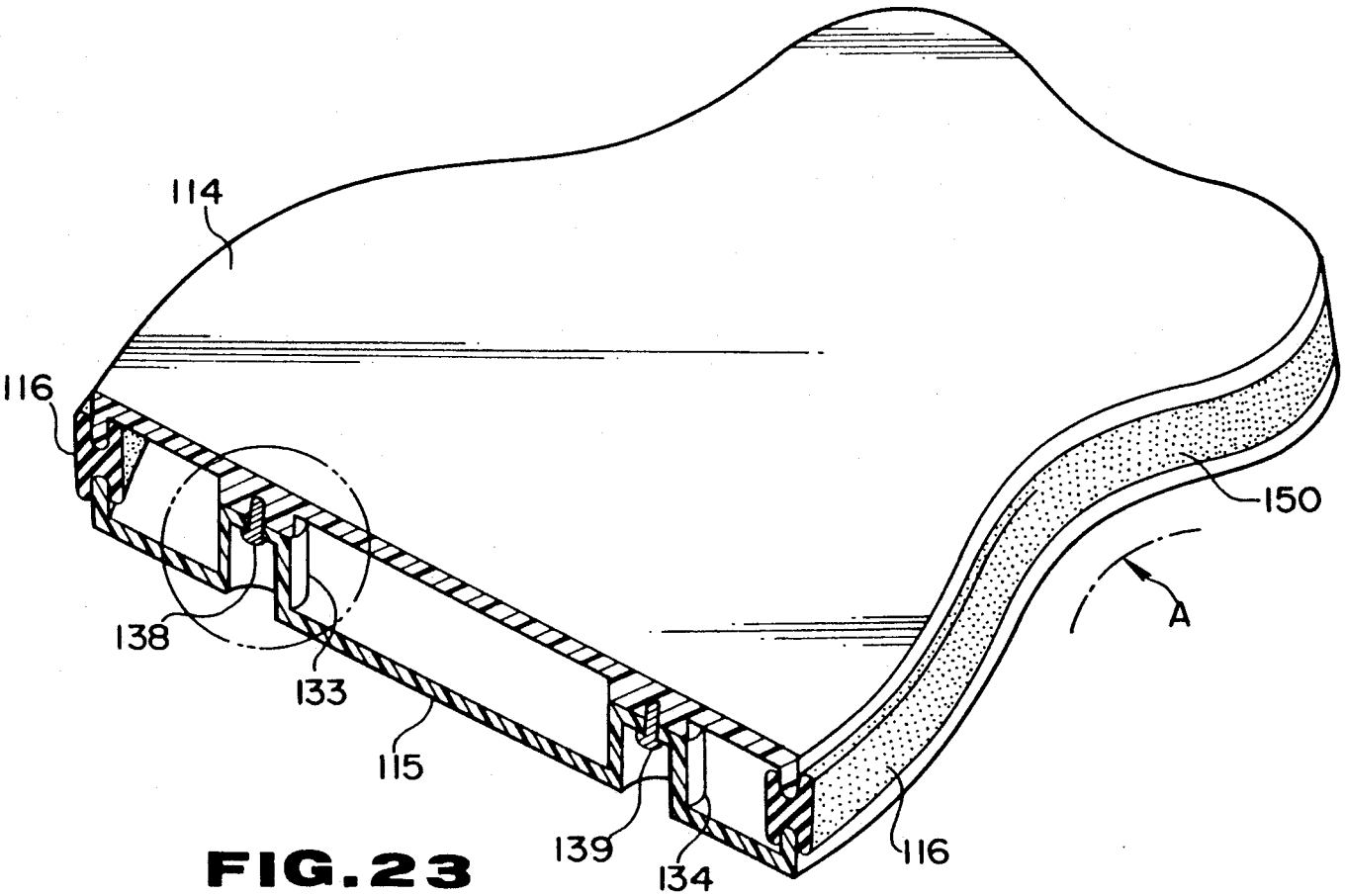
FIG. 23 is a perspective view showing the electronic stringed musical instrument shown in FIG. 21, a part of which is broken.

Graining work is applied on the outer peripheral surface of the packing member 116 as shown in FIG. 23, and this packing member 116 is fixed on the substantially whole outer circumference surface of the body portion 1. As shown in FIG. 24, the packing member 116 is preliminary formed to have the same plan shape as that of the outer circumferential surface of the body portion 1 of the stringed musical instrument. When the packing member 116 is formed from very soft material such as soft urethane, natural rubber or silicon rubber by extrusion molding to have a substantially H-shaped cross section, the packing member 116 can have a flexibility to satisfactorily coincide with the shape of the outer circumferential surface of the body portion 1, so that the outer peripheral ribs 19A and 20A of the upper and lower half bodies 114 and 115 ca be satisfactorily fitted into the fitting grooves 21A and 21A in the upper and lower ends of the packing member 116.

In the assembling method of the body portion 1 of this electronic musical instrument, first the electronic parts 113 are mounted in the lower half body 115, and then, the lower side fitting groove 21A of the packing member 116 is fitted over the outer peripheral rib 20A of the lower half body 115. Further, the outer peripheral rib 19A of the upper half body 114 is fitted in the upper side fitting groove 21A of the packing member 116. Finally, the upper and lower half bodies 114 and 115 are connected together by means of the screws 118 to 142.

As the electronic stringed musical instrument is so constructed, the body portion 1 of the electronic stringed musical instrument is assembled with the packing member 116 being interposed between the upper and lower half bodies 114 and 115. The packing member 116 is made of very soft material such as soft urethane, natural rubber, silicone rubber or the like, and is softer than the material of the body portion 1. Therefore, when the body portion 1 is assembled by the screws 138 to 142 which constitute the fixing means, the packing member 116 is flexibly deformed by only the slight deformation of the outer peripheral ribs 19A and 20A of the packing member 16, so that the outer peripheral ribs 19A and 20A are perfectly in close contact with the packing member 116. In other words, no gaps are produced between the outer peripheral ribs 19A and 20A of the upper and lower half bodies 114 and 115 and the packing member 116.

Thus, since gaps between the outer peripheral ribs 19A and 20A of the upper and lower half bodies 114 and 115 are filled with the packing member 16, no noises are produced by the collision of the outer peripheral rib 19A of the upper half body 114 and the outer peripheral rib 20A of the lower half body 115. Further, when there is varieties in the tightening forces of the screws 138 and 142 which constitute the fixing means, the change of the relative positions of the outer peripheral ribs 19A and 20A, due to the deformation of the upper and lower half bodies 114 and 115 resulting from variation in the tightening forces, is absorbed by the packing member 116, and no gaps are produced between the upper and lower half bodies 114 and 115 and the packing member 116. Accordingly, this packing member 116 prevents the production of noises, which is caused by the variation of the assembling dimension of the body portion 1 and the variation of working dimensions of the seating surfaces of the outer peripheral ribs 19A and 20A of the upper and lower half bodies 114 and 115, so that there are no noises to be transmitted to the strings 5 and the pick-up 8.

Still further, since the echoes (designated by arrow "A" in FIG. 22A), produced in the body portion 1 when the strings 5 are vibrated, and the vibration of the body portion 1 are efficiently absorbed by the packing member 116, the body portion 1 is hard to be sympathetically vibrated to the echoes. This is because the packing member 116 is made of soft material such as soft urethane, natural rubber, silicone rubber, or the like, and it repeats shrinkage and expansion in accordance with the vibrations of the upper and lower half bodies 114, 115, so that the vibration is changed to the heat energy. Therefor, the body portion 1 is hard to be vibrated (the resonance point is not within an audible frequency range) when the strings 5 are touched, balanced sound stresses can be obtained from the low frequency range to the high frequency range.

When the body portion 1 does not have a waist portion 50 as designated by arrow "A" in FIG. 23, the packing member 116 closely contacts the thigh of a sitting player while he plays the electronic stringed musical instrument. In particular, since the surface of the packing member 116 is grained, the electronic stringed musical instrument is not slipped off the thigh.

Since the packing member 116 is fixed to the substantial whole length of the outer peripheral surface of the body portion 1 of the electronic stringed musical instrument, the packing member 116 well acts to prevent the instrument from slipping off the thigh of the player irrespective of the positions of the player's feet.

When the body portion 1 is assembled without removing burrs produced at the time of molding the upper and lower half bodies 114 and 115, the packing member 116 is deformed to wrap the burrs upon fitting the outer peripheral ribs 19A and 20A to the fitting grooves 21A, 21A of the upper and lower end surfaces of the packing member 116. This eliminates the burr removing process which has been conventionally necessary.

Since the fitting grooves 21A and 21A are formed to be fitted with the outer peripheral ribs 19A and 20A of the upper and lower half bodies 114 and 115 fixed thereinto, no adhesive is required at the time of assembling the body portion 1. Therefor, the body portion 1 can be quickly assembled only by fitting the outer peripheral ribs 19A and 20A of the upper and lower half bodies 114 and 115 to the fitting grooves 21A, 21A.

When the electronic stringed musical instrument is struck against something or dropped by mistake, the packing member 116, interposed between the seating surfaces of the outer peripheral ribs 19A and 20A of the upper and lower half bodies 114 and 115 which are the weakest against the external shocks, absorbs these shocks, and protects the electronic stringed musical instrument from the breakage. This improves the reliability of the mechanical strength of the instrument.

As understood from the above-mentioned description, this invention is applicable to all stringed musical instruments with frets, including guitars, lutes and banjos which are traditional stringed musical instruments and electric or electronic stringed musical instruments such as electronic violins.

What is claimed is:

1. A stringed musical instrument, comprising:

a neck member formed of a synthetic resin material and having a fingerboard surface on which a fingering operation of a player is to be conducted; and a fret structure member formed of a metallic material and having a plurality of frets located at predetermined intervals, each of the frets having a base end portion and a top end portion, and a connection member connecting the base end portions of said plurality of frets with one another; wherein said fret structure member is fixed to said neck member with said base end portions of said frets and said connection member buried in said neck member and with only said top end portions of said frets projecting from said fingerboard surface.

2. The instrument according to claim 1, wherein said synthetic resin material is fiber-reinforced resin material.

3. The instrument according to claim 1, wherein said connection member has an engaging portion for increasing a connecting force for connecting said connection member to said neck member.

4. The instrument according to claim 1, wherein said instrument further comprises a neck-reinforcing member integrally formed with said connection member and extending along an inner periphery of said neck member, for reinforcing said neck member.

5. The instrument according to claim 1, wherein said instrument further comprises:

a head portion integrally formed on one end of said neck member; and a head support member integrally formed with said connection member of said fret structure member and embedded in an interior of said head portion for supporting said head portion.

6. The instrument according to claim 5, wherein said instrument further comprises a string support member integrally formed with said head support member for supporting one end of at least one string to be stretched on said fingerboard surface.

7. The instrument according to claim 5, wherein said instrument further comprises:

a body member integrally formed with another end of said neck member; and a body support member integrally formed with said connection member of said fret structure member, and embedded in an interior of said body member for supporting said body member.

8. The instrument according to claim 7, wherein said instrument further comprises a string support portion integrally formed with said body support member for supporting one end of at least one string to be stretched on said fingerboard surface.

* * * * *